US005854379A

United States Patent [19]

Takayama et al.

[11] Patent Number: 5,854,379

[45] Date of Patent: Dec. 29, 1998

[54] THERMAL DECOMPOSITION DEGREASING METHOD AND MOLDED PRODUCTS THEREOF

[75] Inventors: Takemori Takayama; Yoshitaka Ohyama; Kazuo Okamura, all of Osaka; Masato Miyake, Ishikawa; Katsuyoshi Saito, Kyoto; Hiroshi Ono, Saitama, all of Japan

[73] Assignee: Kabushiki Kaisha Komatsu Seisakusho, Tokyo, Japan

[21] Appl. No.: 775,884

[22] Filed: Jan. 2, 1997

Related U.S. Application Data

[63] Continuation-in-part of Ser. No. 403,199, Mar. 13, 1995, Pat. No. 5,627,258.

[30] Foreign Application Priority Data

Mar. 14, 1994 [JP] Japan ..... 6-42643
Oct. 25, 1996 [JP] Japan ..... 8-284336

[51] Int. Cl.[6] ..... C08G 73/10; C08K 5/3477

[52] U.S. Cl. ..... 528/338; 528/310; 528/322; 528/329.1; 528/339; 528/340; 528/341; 524/100; 524/227; 524/600; 524/606; 419/32; 419/36; 419/37; 419/38; 419/41; 419/44; 419/53; 419/57; 264/63; 264/344; 264/645; 264/656; 264/657; 264/670

[58] Field of Search ..... 528/310, 322, 528/329.1, 338, 339, 340, 341; 524/100, 227, 600, 606; 419/57, 53, 36, 37, 54, 41, 44, 38, 32; 264/63, 344, 657, 645, 656, 670

[56] References Cited

U.S. PATENT DOCUMENTS

| | | | |
|---|---|---|---|
| 5,059,388 | 10/1991 | Kihara et al. | 419/37 |
| 5,531,958 | 7/1996 | Krueger | 419/44 |
| 5,627,258 | 5/1997 | Takayama et al. | 528/338 |

*Primary Examiner*—P. Hampton-Hightower
*Attorney, Agent, or Firm*—Armstrong, Westerman, Hattori, McLeland & Naughton

[57] ABSTRACT

A low-cost thermal decomposition degreasing method capable of drastically reducing the time required for a degreasing process which involves heating, vaporization and thermal decomposition, while assuring the shape retention property of an injection molded product during degreasing. The degreasing process comprises: (i) a first step wherein a molded product placed under a reduced pressure less than or equal to atmospheric pressure is heated at a temperature lower than the melting point of a thermoplastic binder so that the thermoplastic binder partially evaporates by 5 wt % or more, and then the molded product is further heated at a temperature lower than higher one of the melting points of a more volatile organic compound and a thermoplastic resin whereby the thermoplastic binder further evaporates by 10 wt % or more, and wherein the final temperature is set to 200° C. or less; and (ii) a second step wherein the molded product is heated to a temperature higher than or equal to the highest one of the melting points of thermoplastic binder components at a pressure higher than or equal to atmospheric pressure in an atmosphere of gas inert relative to a powder material constituting the molded product.

21 Claims, 6 Drawing Sheets

THERMAL DECOMPOSITION DEGREASING METHOD AND MOLDED PRODUCTS THEREOF

This application is a continuation-in-part of application Ser. No. 08/403,199, filed Mar. 13, 1995, now U.S. Pat. No. 5,627,258.

TECHNICAL FIELD

The present invention relates to a thermal decomposition degreasing method for removing a thermoplastic binder from an injection-molded product that is formed from a powder material mixed with the thermoplastic binder and to molded products produced therewith.

BACKGROUND ART

In powder injection molding, a thermoplastic binder made from a thermoplastic resin or wax is usually used in order to impart flowability and pressure moldability to a powder material such as a metal, ceramic or cermet. As a measure, the amount of such a thermoplastic binder to be added is about 44 to 55% by volume in consideration of the relation with the sphericity of the used powder material. Subsequent to injection molding, the molded product is degreased to remove the thermoplastic binder prior to sintering. In this degreasing process, the injection molded product is heated in an inert atmosphere so that the binder dissolves, decomposes and evaporates. During the degreasing process, the injection molded product formed from a powder material is brought into a structurally unstable condition because of dissolving of the binder which has coated the powder material and because of the inherent weight of the product itself. In addition, when the pressure caused by the decomposition/vaporization of the binder is imposed on the molded product in the above unstable condition, the particles of the powder material move and the molded product is collapsed under the influence of its own weight, resulting in deformation. If heating temperature is raised to promote the removal of the binder, the binder is boiled and transformed into a vapor, causing swelling, cracking and flawing. Therefore, it is necessary in the degreasing process to slowly proceed removal of the binder in order to prevent occurrence of defects. Although degreasing time principally depends on the size and thickness of the molded product to be processed, it usually takes two or three days to perform the degreasing process. Accordingly, there have been demands for the development of a degreasing method that is capable of removing a thermoplastic binder from an injection-molded product in a short time while maintaining the integrity of the molded product and preventing occurrence of defects such as deformation due to its own weight, blister and cracks.

There have been proposed several techniques to meet the above demands. One example of such techniques is disclosed in Japanese Patent Publication No. 61-48563 (1986) in which degreasing is carried out with a turbulent flow of inert gas which is blown to an injection-molded product to absorb part of binder components dissolved in a porous form. Japanese Patent Publication No. 62-33282 (1987) discloses a degreasing method in which ambient pressure for an injection-molded product is maintained to be no less than the vapor pressure of the thermoplastic binder.

U.S. Pat. No. 5,122,326 discloses a degreasing method in which while heating a shaped article that is formed by use of a thermoplastic binder composed of a low melting point paraffin wax and a higher melting point high-molecular binder component, the wax is vaporized in a solid state without formation of a liquid binder phase in a vacuum atmosphere of $5\times10^{-4}$ torr or more created by a diffusion pump, and then the high-molecular binder component is vaporized without formation of a liquid binder phase in a vacuum atmosphere attainable by a mechanical pump.

Japanese Patent Publication No. 4-74769 (1992) discloses a degreasing method in which after a thermoplastic binder has been partially removed through vaporization by heating the molded product at a low temperature higher than or equal to the softening temperature of the molded product, the molded product is pressurized by a pressurizing means at a pressure sufficient to retain the shape of the molded product in the pressurizing step and then most of the thermoplastic binder is removed through vaporization in an atmosphere inactive to the powder material.

Japanese Patent Laid-Open Publication No. 8-25802 (1986) proposes a degreasing method comprising the steps of (1) partially vaporizing the thermoplastic binder by heating the molded product at a temperature lower than the melting point of the binder under reduced pressure; (2) heating the molded product to a temperature higher than the melting point of the binder at a pressure above atmospheric pressure in an atmosphere of inert gas; and (3) raising the temperature of the atmosphere at least to such an extent as to remove most of the thermoplastic binder through vaporization, while lowering the pressure in the gas atmosphere below atmospheric pressure.

There are serious problems in the art. In the case of degreasing an injection molded product formed from a metal powder, carbon tends to remain in the resulting degreased product owing to thermal decomposition of the binder. In the case of carrying out degreasing in air that is an oxidation atmosphere, the oxidation of the metal powder tends to cause cracking. Further, sintering temperature varies owing to a failure in controlling the carbon content or components of the sintered product obtained after sintering. Some attempts to overcome these drawbacks have been reported, which are (i) selection of suitable binders for use in injection molding, (ii) chemical composition adjustment and degreasing carried out in an atmosphere of an $N_2$, Ar or $H_2$ gas, and (iii) atmospheric gas adjustment during sintering. These techniques are disclosed in Japanese Patent Laid-Open Publications Nos. 5-331503 (1993), 6 -200303 (1994) and 6-73406 (1994).

In the technique disclosed in Japanese Patent Publication No. 61-48563 (1986), although it is suggested that use of a turbulent flow of blown gas promotes vaporization of the thermoplastic binder while preventing occurrence of blister and cracks in the injection molded product during degreasing, it is practically difficult to maintain a uniform turbulent flow within a degreasing furnace. Even if temperature can be kept uniform, the binder removing speed on the side of an injection-molded product exposed to blown air differs from that on the side opposite to the exposed side, with the result that the degree of degreasing undesirably varies within a single piece of injection molded product. When a setter is used for effective arrangement of injection molded products in a degreasing furnace, non-uniform degreasing is often seen in areas contacting the setter or areas from which a turbulent flow of air is shut out. When a plurality of injection molded products are processed in a binder removal furnace, such non-uniformity is particularly remarkable and results in variations in the degree of degreasing between the injection molded products. For the above reason, it is practically infeasible to produce sound degreased products free from defects such as deformation due to their own weight, blister and cracks. It is also contemplated in the above publication that a thermoplastic binder composed of binder components of different melting points is used and these components are allowed to sequentially, gradually flow out from the injection molded product in the form of liquid to be absorbed by a porous absorber so that removal of the binder can be promoted while preventing occurrence of blistering and cracking. However, this method is rather impractical in consideration of the problems that (i) since the binder is removed from a molded product in the form of liquid, the molded product tends to fail in withstanding their own weight during the degreasing process, resulting in collapse and (ii) the progress of degreasing varies within a molded product similarly to the above case when the binder absorber is disposed in partial contact with the molded product. In addition, as there are some requirements for arranging a plurality of molded products within a degreasing furnace, it is difficult to carry out stable degreasing to obtain a number of acceptable molded products free from deformation due to their own weight, blister and cracks.

According to Japanese Patent Publication No. 62-33282 (1987), the ambient atmosphere during degreasing is always kept in a pressurized condition, so that the boiling point of the thermoplastic binder contained in the molded product rises, causing a great difference between the melting point and boiling point of the thermoplastic binder and this difference is greater than that in the case of degreasing performed under atmospheric pressure. This restricts the boiling/vaporization of the thermoplastic binder contained in the injection molded product and is therefore thought to be effective in preventing occurrence of defects such as blister and cracks. However, to keep the atmosphere of the interior of a debindering furnace in a pressurized condition all the time causes a rise in the boiling point of the thermoplastic binder as mentioned above, resulting in slow binder vaporization. In other words, the progress of the removal of the binder is shifted to the higher temperature region, compared to the case of the binder removal carried out under atmospheric pressure, so that degreasing does not virtually proceed in the temperature region in the vicinity of the melting point of the thermoplastic binder where deformation due to the weight of the product is most likely to occur. Accordingly, there are the drawbacks that the molded product cannot be free from deformation due to its own weight and that it is necessary to raise temperature upon completion of degreasing to a level corresponding to the pressure of the ambient atmosphere, which results in prolonged degreasing time.

U.S. Pat. No. 5,122,326 proposes that a thermoplastic binder for a shaped product contains a low melting point paraffin wax in place of camphor which serves as a sublimable substance and this paraffin wax is preferentially vaporized in a high vacuum atmosphere created by a diffusion pump in such a manner that the paraffin wax remains in a solid state without decomposition, whereby removal of the binder can be carried out without causing deformation of the shaped article. However, this technique has some disadvantageous characteristics. Paraffin wax that is a low melting point wax is mainly composed of a normal chain saturated hydrocarbon having a carbon content of 20 to 30, more precisely, a carbon content of 24 or 25 and has a molecular weight of 300 to 500, a melting point of 32° to 65° C., and a boiling point of about 400° to 500° C. (at 1 atmospheric pressure). The boiling point is approximately 400° C. higher than the average melting point (=about 50° C.) as understood from above. It is anticipated that there is a need to remove at least about 50% of the paraffin wax by heating at 50° C. (i.e., average melting point) under a pressure of $5\times10^{-4}$ torr or more (that is the vapor pressure of hydrocarbon having a carbon content of up to 24 and contained in the paraffin wax of the thermoplastic binder by about 50 wt %), and therefore a high-performance vacuum system is required, which is capable of constantly keeping a high vacuum level that is at least a pressure of $5\times10^{-4}$ torr. In addition, the vaporizing amount of the paraffin wax having a low vapor pressure as mentioned above is in proportion with the difference between the vacuum level of the atmosphere and the vapor pressure of the paraffin wax. These characteristics impose a limit in reducing debindering time and lead to involvement of a large capacity vacuum device, adding substantial equipment cost to the debindering furnace.

The technique of U.S. Pat. No. 5,122,326 suffers from other problems: Specifically, (i) a high-performance heat exchanging condenser is needed to collect, at a high rate, the thin vapor of the paraffin wax which has a low congealing point in high vacuum; (ii) the congealing point of the paraffin wax is close to room temperature and therefore the paraffin wax is not thoroughly corrected but likely to deposit and coagulate within the mechanical pump, which impairs the efficiency of the system with troubles, for example, in the mechanical pump; (iii) when performing a large-scale degreasing process in commercial operation, not only the residue of the paraffin wax precipitating within the furnace but also the low-molecular residue which precipitates in the furnace after the thermal decomposition of the high-molecular components of the thermoplastic binder must be cleaned off and various maintenance including diffusion pump oil is necessary so that the production cost increases. It has been reported that the time required for degreasing which is performed under a vacuum condition created by a simple-maintenance mechanical pump is three times as much as that of ordinary degreasing (see "Industrial Materials" P31, Vol. 39, No. 12, 1991, September: Yokose, Kaminaga) and thus the technique of U.S. Pat. No. 5,122,326 has virtually no effect for saving degreasing time.

The polypropylene resin, which is composed of saturated hydrocarbon having the same long normal chain as that of the paraffin wax disclosed in U.S. Pat. No. 5,122,326, is thought to exert good compatibility because of its chemical composition similar to the paraffin wax, but when about 40 wt % or more of the paraffin wax is contained in the thermoplastic binder, the paraffin wax separates to a considerable extent during the step of preparing the injection molding material by mixing so that it bleeds into the mold during injection molding. This leads to defects in releasing of the molded product from the mold, occurrence of burr at the splitting surface of the mold and an increase in the frequency of mold cleaning. Further, as the paraffin wax itself is a soft substance, the molded product is easily broken when released from the mold unless it takes long time to cool the interior of the mold after injection molding. For this reason, this technique is particularly difficult to apply to formation of large-sized parts, the shape of the molded product to be produced is considerably limited, and the technique makes it difficult to automate injection molding. These drawbacks significantly impair the desirable characteristics inherent to the powder injection molding technique such as the highly automated production line and its capability of molding of parts having intricate shapes. For overcoming these problems, the development of a degreasing method is expected, which uses a binder that is capable of imparting high strength to a molded product so that the product can satisfactorily withstand the resistance of the mold upon releasing therefrom and that does not place a limit in the shape of the molded product to be produced. Further, such a method enables it to perform degreasing quickly and economically at a low vacuum level obtainable by an easy-maintenance mechanical pump.

Japanese Patent Publication No. 4-74769 (1992) discloses a technique which involves a pressurizing step for applying a pressure at which the molded product does not lose its shape to the molded product after part of the thermoplastic binder has been vaporized at a low temperature lower than or equal to the softening point of the injection molded product, whereby the voids which were formed in the prior step of degreasing can be compressed, bringing the particles of the powder material into mutual contact. This prevents deformation of the product during the final thermal decomposition step for removing most of the remaining thermoplastic binder, while reducing debindering time. However, provision of such an additional pressurizing step in debindering increases the number of degreasing steps, increasing not only technical complexity but also system cost. Therefore, there are demands for the development of a degreasing method which enables quick degreasing by heating without involving a pressurizing step.

Japanese Patent Laid-Open Publication No. 8-25802 discloses a technique comprising the steps of (i) removing part of the thermoplastic binder by heating under reduced pressure and at a temperature lower than the melting point of the thermoplastic binder; (ii) creating gas escaping paths in the molded product by heating it to a temperature higher than or equal to the melting point of the thermoplastic binder in a gas atmosphere at a pressure above atmospheric pressure while ensuring the shape retention property of the molded product, so that a large amount of gas generated in the subsequent step can escape through the escaping paths, thereby preventing blister and cracks caused by gas generation; and (iii) removing most of the remaining thermoplastic binder in a gas atmosphere at a pressure lower than or equal to atmospheric pressure. However, this publication aims to prevent degreasing defects in the molded product but does not suggest a technique which brings about a reduction in degreasing time and degreasing cost and brings about applicability to large-sized parts, so that there still remains an outstanding theme for developing a degreasing method which is capable of producing defect-free degreased products in a short time.

Japanese Patent Laid-Open Publication No. 7-305101 discloses in the description of the embodiments that the carbon content of an iron type sintered product which has undergone degreasing in an atmosphere of $N_2$ gas inactive with respect to metal powder significantly varies according to the maximum temperature upon completion of degreasing and to the composition of the binder used, but in any cases, the residual carbon content is difficult to control in an atmosphere of inactive $N_2$ gas or Ar gas and this point is also reported by other literatures.

It has been reported that when removal of a binder is carried out in air, thermal decomposition of a thermoplastic binder is more accelerated with increasing temperature from 200° C., compared to the case of thermal decomposition degreasing in an $N_2$ gas atmosphere, but degreasing speed rapidly drops in the region after temperature has reached 250° C. because of formation of residual carbon, and that the formation of residual carbon creates internal stress, making the molded product more liable to cracking. It has been also reported that if a metal powder susceptible to oxidation is used, an oxide is newly created on the surface of the metal, with the result that the molded product is expanded during degreasing and therefore more likely to crack.

Further, when degreasing is carried out in air, the residual carbon content becomes substantially zero or oxygen remains as an oxide, or the amount of carbon originally contained in the metal powder decreases. Therefore, a troublesome adjustment is required, that is, the carbon content of the sintered product has to be adjusted by carefully selecting the type of a powder material to be used, the type of a binder to be used, compounding ratio, degreasing conditions and others.

Miura et al. has proposed a method for adjusting the residual carbon content by carrying out degreasing in an atmosphere of an $N_2$ gas mixed with a $H_2$ gas at a high ratio. It is also contemplated from the difference in the residual carbon content between the case of degreasing in an atmosphere of an $N_2$ gas and the case of degreasing in air that the carbon content can be adjusted by mixing a flow of inert gas such as $N_2$ with air or oxygen.

The details of one example of the above method are reported by "Journal of The Japan Society of Powder and Powder Metallurgy" (Vol.40, No.4, P388). This method controls the carbon content by introducing hydrogen in an atmosphere of $N_2$ gas. According to this method, when degreasing is carried out at a temperature of 400° C. (this temperature is a very common degreasing condition), a large amount of hydrogen is required to be added to $N_2$ gas for controlling the carbon content, so that handling of hydrogen enriched gas to be taken out of the furnace is very dangerous. In consequence, it becomes necessary to control the evaporated and removed binder and employ a security system for preventing explosion. Another disadvantage is that the effect of $H_2$ gas for controlling the carbon content is small. The method disclosed in Japanese Patent Laid-Open Publication No. 6-200303 suffers from similar problems.

In the method in which air or oxygen is directly added as disclosed in Japanese Patent Laid-Open Publication No. 5-331503, the carbon content of a degreased product is controlled by the direct reaction (this reaction is described by the following formula) between oxygen and carbon which starts to remain in the degreased product. The principle of this method differs from that of the above-described method in which hydrogen is utilized, and it is anticipated that with this method, the residual carbon content can be more effectively controlled compared to the hydrogen addition method.

$$C(S)+(½)O_2(G)=CO(G)\ [(S)\text{: solid, }(G)\text{: gas}]$$

In reality, the direct oxidation reaction of carbon is however a violent exothermic reaction and particularly when oxygen is added into an inert gas such as $N_2$ in a slight amount, the reaction of oxygen proceeds more violently according to Le Chatelier's law. Therefore, when degreasing a number of molded products, this method has difficulty in controlling the carbon contents of a number of molded products so as to be uniform and cannot avoid the possibility of occurrence of cracks in the molded products which are directly exposed to the introduced gas because of the excessive oxidation reaction. This is the case with the degreasing technique disclosed in Japanese Patent Laid-Open Publication No. 6-192706 (1994) wherein degreasing is performed under an atmosphere of oxygen-enriched air.

The present invention has been made taking the foregoing drawbacks into account, and one of the objects of the invention is therefore to provide an economical thermal decomposition degreasing method capable of largely reducing the time required for a degreasing process which involves heating, vaporization, volatilization and thermal decomposition, while ensuring the shape retention property of an injection molded product during the degreasing process.

Another object of the invention is to provide a thermal decomposition degreasing method which uses a powder-injection-molding binder that can impart good physical properties such as strength and toughness to a molded product in order to reduce injection molding and degreasing defects and that contributes to saving of degreasing time.

A further object of the invention is to provide a thermal decomposition degreasing method capable of controlling the residual carbon content of a degreased product produced by degreasing subsequent to injection molding of a metal powder material and the residual carbon content of a sintered product produced by sintering the above degreased product.

DISCLOSURE OF THE INVENTION

The foregoing objects can be achieved by a thermal decomposition degreasing method for removing a thermoplastic binder from a molded product formed by injection molding of a powder material mixed with the thermoplastic binder, wherein the thermoplastic binder is composed of a highly volatile organic compound and a thermoplastic resin, and wherein a degreasing process comprises:

(a) a first step for heating the molded product at a temperature lower than the melting point of the thermoplastic binder, the molded product being placed in a reduced pressure condition lower than or equal to atmospheric pressure, so that the thermoplastic binder partially evaporates by 5 wt % or more and for further heating the molded product at a temperature lower than higher one of the melting points of the highly volatile organic compound and the thermoplastic resin so that the thermoplastic binder partially evaporates by 10 wt %, the final temperature of the first step being 200° C. or less; and (b) a second step for heating the molded product up to a temperature higher than or equal to the highest one of the melting points of the components of the thermoplastic binder at a pressure higher than or equal to atmospheric pressure in an atmosphere of a gas that is inactive relative to the powder material constituting the molded product.

According to the invention, the thermoplastic binder is generally composed of two or more organic materials and when measuring the melting point of the binder for example by the thermal analysis, a temperature lower than the melting point or glass temperature of each component, or a temperature equal to the melting point of a substance which has the lowest melting point or lowest glass temperature among all is observed. Hence, either of the above temperatures is regarded as the melting point of the thermoplastic binder in this specification. The common interpretation of a melting point is a softening point (softening temperature) at which a shaped product cannot withstand its own weight and loses its shape. The concept of a melting point adopted in this specification is substantially consistent with this common interpretation and considered to be rational in view of the resistance of the molded product against deformation.

In order to ensure the flowability of the molding material during injection molding, the amount of the thermoplastic binder to be added to the powder material should be sufficient to completely fill the voids between the particles of the powder material while uniformly coating the particles, so that the volume of the binder is 1.1 times that of the voids, and more specifically the molded product contains about 40 to 55 wt % the thermoplastic binder. Therefore, the first step of the invention not only involves removal of the highly volatile organic compound under reduced pressure and at a temperature lower than or equal to the softening temperature of the molded product (i.e., the melting point of the thermoplastic binder), but also may include the following stages (1), (2) or (3): (1) 5% or more of the entire amount of the binder is quickly vaporized whereby the quantitative relationship between the powder material and the thermoplastic binder becomes more suitable for dramatically increasing the chance for mutual contact between the particles. This markedly enhances the resistance of the molding product against softening, that is, flowability is impeded thereby to ensure the shape retention property of the molded product during the degreasing process.

(2) In this stage, as the highly volatile compound has vaporized from the thermoplastic binder, the chemical composition of the thermoplastic binder becomes similar to that of a less volatile thermoplastic resin, with the melting point of the binder increasing and getting closer to the melting point or glass temperature of the thermoplastic resin. Accordingly, the softening resistance of the molded product is more improved and therefore the shape retention property during the degreasing process is ensured. In this situation, degreasing under reduced pressure is continued with heating temperature being raised to a temperature lower than the melting point of the thermoplastic resin which is a strength component of the thermoplastic binder, whereby 10 wt % or more of the highly volatile organic compound is vaporized. With this step, the quantitative relationship between the powder material and the thermoplastic binder becomes more favorable to perfectly maintain the integrity of the molded product during degreasing. (3) While the good shape retention property is ensured at temperatures higher than or equal to the respective melting points of the binder components, the highly volatile organic compound is preferentially removed from the molded product under reduced pressure thereby to create many escaping paths for gas evacuation. The first step may include the stages (2) and (3), which can eliminate the need for pressurization in the second step for forming many escaping paths. Also, the first step may include the stages (1) and (2), or the stages (1), (2) and (3), whereby degreasing time in the second step can be reduced.

In cases where the melting point of the highly volatile organic compound is higher than that of the thermoplastic resin, the above requirements concerning temperatures less than the melting point of the thermoplastic binder and temperatures less than the melting point of the highly volatile organic compound are applicable.

The reason why the final temperature in the first step is set to 200° C. is that if most of the organic materials are heated above 230° C., they are more likely to decompose into lower molecular compounds or polymers. When the materials are heated under reduced pressure, this decomposition is accelerated as stipulated by Le Chatelier's Law and decomposed gas is generated from the molded product, increasing the possibility of cracking of the molded product. In addition, although the gas can be collected as solidified substances when it is cooled outside the heating furnace, perfect collection is practically infeasible because the solidified substances to be discharged are large in amount in most cases. As a result, troubles occur in the vacuum pump as well as in other parts so that there arises a need for an additional device for eliminating such troubles, which adds substantial cost to the system.

Abrupt binder decomposition is unavoidable at a temperature of 230° C. or more in the subsequent second step. Utilizing this abrupt binder decomposition, the first step is arranged such that 20% of the entire amount of the binder has been removed upon reaching of the final temperature, which enables prompt degreasing without occurrence of defects such as cracking and swelling within the molded product even if the above mentioned decomposed gas is generated. In this case, the rate of degreasing is increased so as to remove 20% or more of the binder upon completion of the first step, instead of restraining the abrupt gas generation due to the decomposition of the thermoplastic binder by bringing the inert gas atmosphere of the second step into a pressurized condition higher than or equal to atmospheric pressure. With this arrangement, escaping paths for decomposed gas evacuation can be created sufficiently to prevent the degreasing defects caused by the above described abrupt generation of decomposed gas at atmospheric pressure in an inert gas atmosphere, while increasing decomposition speed in the following step to reduce degreasing time.

The invention preferably includes a third step in which heat degreasing is accelerated at a pressure less than or equal to atmospheric pressure in a gas atmosphere to reduce degreasing time. As the degreasing time reduction effect of the third step is small, the third step may be omitted by increasing temperature in the second step to allow most of the thermoplastic binder to evaporate and decompose for removal.

In the invention, if heating temperature in the second and third steps, in which the molded product is heated at atmospheric pressure in an atmosphere of a flowing inert gas such as $N_2$ or Ar to vaporize, decompose and remove the residual binder, rises to about 230° C. or more, high molecular materials including a lubricant and polyamide resin material which are the main components of the residual binder tend to be decomposed, low-molecularized and gasified within the heating section of the furnace. At the same time, the amount of residual carbon due to carbonization increases so that a residual stress is newly created. This can lead to degreasing defects and also impose some possibilities of sintering defects including variations in sintering density during and after sintering. In order to avoid such troubles, the second and third steps of the invention are preferably arranged such that $CO_2$ gas is introduced into the inert gas atmosphere, thereby controlling oxidation and preventing the above-mentioned carbonization so that the carbon content of the degreased product obtained after degreasing and the residual carbon content of the sintered product obtained after sintering can be controlled.

The thermal decomposition of the lubricant and the polyamide resin in an atmosphere of inert $N_2$ or Ar gas is very slow compared to the decomposition in the presence of oxygen and the organic material vaporizes, decomposing in a large molecular weight unit, so that expansion at the time of vaporization is little and occurrence of degreasing defects can be reduced. For this reason, the atmospheric gas used in the second step contains an inert gas as a principal constituent and also contains $CO_2$ gas.

In order to overcome the above-described technical problems relating to the direct addition of oxygen and the above-described dehydrogenation and to control the amount of residual carbon generated through carbonization, the invention is arranged such that a carbon dioxide gas is introduced into an inert gas such as a $N_2$ gas thereby promoting oxidation according to Le Chatelier's Law and creating a moderate oxidized atmosphere. This means has been conceived with the fact that the oxidizing reaction [$C(S)+CO_2(G)=2CO(G)$] between a carbon dioxide gas and carbon remaining in a molded product even at about 600° C. (this is the final heating temperature of the customary binder removal) in the course of binder removal is an endothermic reaction. Accordingly, the residual carbon content can be effectively controlled and occurrence of cracking due to excessive oxidation and the excessive carbonization of the binder can be prevented. It should be noted that the above effect of $CO_2$ gas can be easily achieved not only by adding a small amount of $CO_2$ to an inert gas such as $N_2$ but also by introducing $CO_2$ in a vacuum atmosphere and hence, this means is applicable to the third step effected under reduced pressure.

$$C(S)+CO_2(G)=2CO(G);\ \Delta G1=40800-41.7T$$

$$C(S)+(½)O_2(G)=CO(G);\ \Delta G2=-26700-20.95T$$

$$350°\ C.(623K)\Delta G1=14820,\Delta G2=-39752$$

In the invention, the forgoing problems are solved by use of a binder containing water-soluble amide compound(s) and/or water-soluble amine compound(s) as the water-soluble component of the binder, these compounds having no thermoplasticity and a molecular weight of about 1,000 or less so that their polymerization degree is substantially negligible. For providing the binder with the properties of a thermoplasticizer, a polyamide resin which has compatibility with the above water-soluble compound(s), excellent strength and excellent heat resistance is employed as the water-insoluble component of the binder. In addition, the water-soluble compound(s) of which polymerization degree is substantially negligible does not cause thermal decomposition and therefore low molecularization when it is mixed with a powder material by heating, which allows the mixture material to flow stably, resulting in stable injection molding and solves the problem in reuse of runner and sprue material.

In the thermal decomposition degreasing method of the invention, the highly volatile organic compound is composed of amide and/or amine compound(s) and the thermoplastic resin is a polyamide resin.

The first step of the degreasing process does not require a diffusion pump capable of providing high vacuum levels ($\leqq 5\times10^{-4}$ torr). The first step can be effected by heating the molded product in a vacuum condition (>0.05 torr) that is lower than the ultimate vacuum of a normal mechanical pump whereby part or all of the highly volatile amide and/amine compound(s), which is contained by 40 to 70 wt % in the injection molding binder as the principle constituent, can be evaporated and removed. In addition, by use of the amide type thermoplastic binder, occurrence of deformation can be prevented in the degreasing process; the residual binder can be promptly removed by heating in the second step of the degreasing process without producing degreasing defects; and a considerable reduction in degreasing time can be effectively, easily achieved. By virtue of these advantages as well as the strength property of the binder, the limitations on the shape of the molded product can be eliminated and the reduction of degreasing time allows the powder injection molding technique to have more applicability to large-sized, thick, shaped articles.

The highly volatile organic compound should be selected taking the following conditions into account: (i) a normal mechanical pump cannot constantly provide high vacuum levels of 0.05 torr or more and the vacuum level which can be ensured by such a pump when a number of injection molded products are degreased at the same time is 0.1 torr; (ii) when the melting point of the highly volatile organic compound exceeds 190° C., the flowability of the binder is impaired, resulting in decreased injection moldability; (iii) when the boiling point of the highly volatile organic compound is below 175° C., the compound preferentially vaporizes from the binder when the binder is being mixed with the powder material or during the injection molding process so that there arise problems in the stability of injection molding and in the reusability of return material; and (iv) when the boiling point is 250° C. or more higher than the melting point, vaporization speed drops in the first step of the degreasing process so that debindering time cannot be satisfactorily reduced. Therefore, the preferable highly volatile organic compound should meet the following requirements which are: (i) the vapor pressure at the melting point is more than or equal to the ultimate vacuum (0.1 torr) of a mechanical pump; (ii) the melting point is in the range of from 50° C. to 190° C.; (iii) the boiling point is in the range of from 175° C. to (the boiling point +250)°C. and (iv) the vapor pressure at the melting point is less than or equal to 100 torr.

As stated above, the highly volatile organic compound constituting the binder of the invention has a seemingly inconsistent characteristic, that is, its boiling point is comparatively low while its melting point is high. Even paraffin wax which is thought to be a substance liable to vaporization in injection molding does not meet this requirement, since the difference between its melting point and boiling point is about 400° C. Therefore, the invention has overcome this difficulty by employing amide(s) and amine(s) having molecular weights of 350 gr/mol or less. This idea has been conceived with the fact that compounds having amide or amine groups exhibit a strong binding property between the amide groups or between amine groups which contributes to an increase in the structural stability of the compounds in a solid state and therefore to a high melting point, while these compounds cannot ensure such a structural stability when they are in a molten state so that a smaller molecular weight substance has a higher vapor pressure and lower boiling point. It is preferable in view of degreasing operation that the highly volatile organic compound has a boiling point of 200° C. to 350° C. and a vapor pressure (at the melting point) of 1.0 torr to 50 torr.

The minimum amount of the amide and/or amine compound(s) contained as the highly volatile organic compound in the thermoplastic binder is 20 wt % in order to ensure the shape retention property of the molded product from which the entire amount of the volatile, amide and/or amine compound(s) is vaporized by heating in the first step of the degreasing process and in order to form escaping paths for evacuating decomposed gas generated in the second step. It is believed that the volatile amide and/or amine compound(s) should be the principal constituent of the binder in order to achieve the prime object of the invention, that is, a drastic reduction in degreasing time. In consideration of the above requirements and the strength of the binder, the amount of the highly volatile organic compound is more preferably 40 to 70 wt %.

In cases where 40 to 70 wt % the highly volatile organic compound consisting of amide(s) and/or amine(s) is used as the principal constituent of the thermoplastic binder, satisfactory strength and mold-release property are required for the molded product in spite of the use of the highly volatile organic compound in such a large amount. According to the invention, the thermoplastic binder comprises, as a strength component, 25 to 60 wt % the polyamide resin such as disclosed in Japanese Patent Laid Open Publication No. 7-305101 (1995) which has good compatibility with the amide(s) and/or amine(s), thereby imparting strength to the molded product so that the molded product withstands handling at the time of mold releasing subsequent to injection molding.

When the volatile component which has vaporized in a vacuum or depressurized condition in the first step is cooled, solidified and collected, the higher melting point the highly volatile amide and/or amine compound(s) has, the easier it is to collect the vaporized component outside the degreasing furnace, so that troubles in the vacuum pumping system can be prevented. In view of this fact alone, the melting point of the highly volatile organic compound is preferably 50° C. or more. Taking into account the effect on the strength of the binder and the feasibility of an economical, simple means for cooling and solidifying the vaporized substances outside the degreasing furnace, it is more preferable that the melting be 70° C. or more.

When the highly volatile substance is removed by heating under a reduced pressure of 0.1 torr or less in the first step, the lubricant can be also partially vaporized and removed from the molded product when heating temperature exceeds 200° C., owing to the relationship between the vapor pressure and heating temperature. However, when heating temperature exceeds 230° C., evaporative gas generated from the amide(s) and/or amine(s), lubricant and others is likely to decompose into a gas of a lower melting point, lower molecular compound in accordance with the principle of the gas reaction in vacuum (Le Chatelier's Law) so that the gas cannot be completely collected with a simple cooler when it is cooled and solidified outside the furnace. As a result, the decomposed substance deposits in the oil of the mechanical vacuum pump, causing troubles to the vacuum pumping system. In order to avoid such troubles, it is conceivable to limit the maximum temperature in the first degreasing step to no more than 230° C. as mentioned before. However, lest temperature variations occur within the furnace in cases a large number of molded products are processed, it is necessary to set the maximum temperature so as not to cause the decomposition of the evaporative gas of the lubricant etc. Thus, it is preferable that the maximum temperature for the first step be limited to 200° C. or less and that upon reaching of this temperature, the operation be switched to the second step where debindering is performed by heating at atmospheric pressure in the atmosphere of an inert gas flow.

When the melting point of the lubricant is 50° C. or less, there is the danger that the evaporative gas cannot be completely collected with a simple cooler outside the furnace even if no low molecularization due to decomposition takes place, so that it deposits in the oil of the mechanical vacuum pump, causing troubles to the vacuum pumping system. In consideration of this, the melting point of the highly volatile organic compound should be more than the minimum temperature of 70° C.

The amide and amine compounds disclosed in Japanese Patent Laid Open Publication No. 7-305101 are water-soluble and, at the same time, have characteristics which substantially meet the above-described requirements for the invention including good volatility. Therefore, they can be generally used as the highly volatile amide and amine compounds of the invention. However, when these compounds are used, it is desirable to take a measure for preventing occurrence of troubles in the vacuum pumping system.

The highly volatile organic compound used in the thermal decomposition degreasing method of the invention is not particularly limited in terms of water-solubility. There are some amine and amide compounds which are poor in volatility, irrespective of their water solubility. Therefore, optimum substance(s) should be carefully selected from amide and amine compounds according to the requirements for the highly volatile organic compound of the invention.

The amide compounds which can be used in the invention contain amide groups and are classified into two groups according the presence or absence of benzene rings within their chemical structures. While the water-soluble amide compounds listed in Japanese Patent Laid Open Publication No. 7-305101 may be used in the invention when considering their vapor pressures, there are amide compounds more suited for use in the invention. Examples of the amide compounds having benzene rings and those having no benzene rings, which are more suitably used in the invention, include: acetamide (water), propionic amide (water), alloxan (water), ethylurethane, ethyleneurea, glycolamide, heptanamide, methylacetamide, methylacetylurea, trimethylurea and ethyl carbamate, nitrobenzamide (o), nitrobenzhydrazide (o), phenylsemicarbazide (1) ($C_6H_5NHCO_2C_6H_5$), phenyl carbamate ester ($C_7H_7C_6H_4O_2CNH_2$), toluyl amide (o), toluyl amide (p), acetaminophenol, aceto naphthalide, aminobenzamide (o), acrylamide (water), 3-acetylindole, 1-acetylsemicarbazide (water), N-acetyl-N'-phenylhydrazine, acetanilide (water), acetotoluide (o), acetotoluide (p), aminoacetophenone (p), diacetamide (water), isovaleramide (water), isobutyramide (water), imidazole (water), methyl carbamate, carbonohydrazide, salicylamide (water), diacetamide (water), N,N'-diethylurea, 3,4-dihydro-2-quinolone, N,N'-dimethylurea, N,N'-diethylurea, dimethylparabanic acid, camphor oxime, succinamic acid (water), succinimide (insoluble), (semicarbazide (water)), (triacetamide), N-(1-naphthyl)acetamide, N-(2-naphthyl)acetamide, 2-pyridone, phthalimidine, benzamide, N-benzoyl-p-toluidine, benzamidoxime, 1-methylhydantoin, p-methoxyacetanilide, octanamide, butyramide (water), hexanamide (water), valeramide (water), stearic acid amide (insoluble). One or more substances are selected from the above amides containing benzene rings and amides containing no benzene rings and used as the highly volatile amide compound(s).

The amine compounds which can be used in the invention contain amine groups and are classified into primary amines and secondary amines. A representative example of the amine compounds is N,N'-diacetylpiperazine (the secondary amine) which is prepared, for example, by dehydrocopolymerization of about one mol of hexahydropiperazine and about 2 mols of acetic acid with a customary method. The suitable primary and secondary amines selected from the water-soluble amines disclosed in Japanese Patent Laid Open Publication No. 7-305101 in consideration of the vapor pressure required for the invention are: 2-aminoquinoline, 3-aminoquinoline, diaminohydrazobenzene (p), hexamethylenediamine, naphthylamine (β), nitro-p-aminophenol (3), nitrophenylhydrazine (p), nitrosoaniline (p), toluylene diamine, toluylene diamine (1;2,4), acetyl-p-phenylenediamine, aminopyridine (2) (α), diformylhydrazine, dipyridyl (4,4'), formylphenylhydrazine (β), glucose phenylhydrazone, hydroxypyridine, methylamino-p-hydroxybenzoic acid (3), methylbenzimidazole (2), methylglyoxalidine, nitrophenylhydrazine (p), phenylglycine (N) and triazole. Examples of the amines which are suitable in view of the volatility required in the invention are: 4-aminoquinoline, 4-pyridylamine, nitroaniline (m), phenylenediamine (o), phenylenediamine (p), 2-acetylpyrrole, p-aminoacetophenone, m-aminophenol, indazole, indolizine, 3,4-xylidine, 1,4-cyclohexanediamine, 2,5-dimethylpiperazine (cis, trans), 3,5-dimethyl piperazole, tyramine, triacetoamine, 2,4,5-trimethylaniline, N-nitrodimethylamine, 2-phenylindole, benzo(h)quinoline, 3-methylindole and 2-methyl-1-phenyl-5-pyrazolone. One or more substances may be selected from the primary and secondary amines and used as the highly volatile amine compound(s). The amide compound(s) and amine compound(s) may be used in combination as the highly volatile organic compound.

As the polyamide resin of the invention, the polyamide resin materials disclosed in Japanese Patent Laid Open Publication No. 7-305101 that is a prior application may be basically used.

As the lubricant for use with the injection molding binder of the invention, all of the normally known lubricants may be used. Concrete examples are available from Japanese Patent Laid Open Publication No. 7-305101. When considering the compatibility between the amide and/or amine compound(s) used as the highly volatile organic compound and the polyamide resin serving as a strength component, preferable examples of the lubricant are aliphatic amides and N-substitution fatty acid amides which have amide groups in their compositions and a normal chain structure. Substituent urea is also preferable as the lubricant. This is also stated in Japanese Patent Laid Open Publication 7-305101.

Technical problems which should be considered when removing the highly volatile substance by heating under a reduced pressure of 0.1 torr or less in the first step have already been pointed out in the foregoing description. There is another risk of troubles which may occur in the vacuum pumping system owing to the evaporative gas of the lubricant when heating temperature exceeds 200° C., as the lubricant which is contained in the binder by 0 to 15 wt % is partially evaporated, decomposed and removed from the molded product, depending on the relationship between vapor pressure and heating temperature. Therefore, consideration should be generally given to the boiling point and decomposing property of a lubricant to be used. However, the lubricants applicable to the invention have no problem in this respect. In cases where the melting point of the lubricant is 50° C. or less, there is such a risk that the evaporative gas cannot be completely collected outside the furnace with a simple cooler even if no low molecularization due to thermal decomposition takes place so that the evaporative gas components deposit in the oil of the mechanical vacuum pump, causing troubles to the vacuum pumping system. Therefore, it is obvious that the preferable melting point of the lubricant is higher than the minimum melting point (70° C.) of the highly volatile organic compound.

According to the invention, the highly volatile amide and/or amine compound(s) is vaporized and removed in the first step of the debindering process by heating under a vacuum or reduced pressure condition that can be easily established by a mechanical pump whereby the shape retention property of the molded product can be ensured. In the second step, the residual binder components are rapidly decomposed into a gas which escapes through escaping paths which have been formed in the first step, which not only enables a sound degreasing process free from swelling and cracking but also significantly reduces debindering time compared to the debindering process carried out at atmospheric pressure in an inert gas atmosphere. Further, when the highly volatile amide and/or amine compound(s) is used by 40 to 70 wt % as the principal constituent of the thermoplastic binder, degreasing carried out by use of the amide/amine compound(s) under a vacuum or reduced pressure condition in the first step assumes the main role of the degreasing process, so that the escaping paths used for evacuating the residual binder components in the second step can be more created. This contributes to an increase in the speed of temperature rising and a dramatic reduction in degreasing time and brought about a significant improvement in the shape retention property and in the prevention of defects during the degreasing process.

While it is stated in the foregoing description that 0 to 15 wt % of the lubricant, examples of which are aliphatic amides, N-substitution fatty acids and substitution ureas, is basically treated as a component different from the highly volatile amide and/or amine compound(s) in the invention, the lubricant consisting of a fatty acid amide or the like is, in fact, vaporized and removed in the substantially same manner as the highly volatile amide compound(s) in the first step of the degreasing process, so that degreasing time can be more effectively reduced.

In order to achieve the effect of the invention, the vacuum level of the first step of the degreasing process should range from a pressure of no more than 0.05 torr to a pressure close to atmospheric pressure. This pressure condition can be provided by a mechanical pump. However, a more marked effect can be achieved by effecting the first step at vacuum levels ranging from a pressure of 0.05 torr to the pressure at the melting point of the highly volatile amide and/or amine compound(s), more concretely, from 0.1 to 100 torr.

In principle, the maximum heating temperature in the first step of the degreasing process could be the final temperature upon completion of degreasing. However, when the heating temperature rises to 230° C. or more, the decomposition of the thermoplastic binder is accelerated so that the binder components are low-molecularized into evaporative decomposition gases some of which are in turn discharged from the furnace, cooled and solidified, while others depositing without liquidation in the mechanical pump which causes a lot of troubles to the system. Therefore, the maximum heating temperature in the first step of the degreasing process is preferably 200° C. or less.

It has been found that the highly volatile amide and/or amine compound(s) collected in the first step of the degreasing process has purity sufficient for reuse.

By continuously performing degreasing operation utilizing a flow of inert gas such as $N_2$ or Ar at atmospheric pressure in the first step, the troubles caused by the binder decomposition gas in the vacuum pumping system etc., cracking due to the carbonization of the binder, and formation of an oxide due to oxidation occurring in the degreasing process when a metal powder material is used as a molding material can be avoided. Further, by introducing small amounts of $CO_2$ gas into a flow of inert $N_2$ or Ar gas at atmospheric pressure in the second step of the degreasing process, the carbon content of a product obtained after sintering when a metal powder is used as a molding material can be controlled without occurrence of cracking during the degreasing process.

The technique of the invention is applicable not only to cases where high gravity metal powder materials are used but also cases where ceramic powder materials such as alumina and SiC are used.

BRIEF DESCRIPTION OF THE DRAWINGS

FIG. 1 is a sectional view of a molded product a.

BEST MODE FOR CARRYING OUT THE INVENTION

Figure 1:
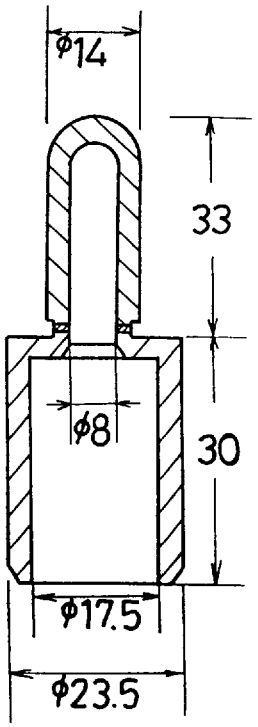

Now, there will be given a detailed explanation on examples of a thermal decomposition degreasing method according to the invention and molded products thereof and their comparative examples.

(A) Binder Composition

As examples of the polyamide resin (strength component) of the invention, the polyamide resin (4) disclosed in Japanese Patent Laid Open Publication No. 7-305101; the polyamide resin (1) disclosed in Japanese Patent Laid Open Publication No. 7-305101; and the nylon 12/ether elastomeric copolymer ("E40S3" produced by Daicel-Huels Ltd.) were used. The polyamide resin (4) is prepared by dehydro-copolymerization of a mixture of $C_{36}$-dimeric acid ("PRIPOL 1013" produced by Unichema International), azelaic acid, ethylenediamine and xylylenediamine, these components being mixed at an equal molecular ratio. The polyamide resin (4) has an average molecular weight of about 40,000. The polyamide resin (1) is prepared by dehydro-copolycondensation of a mixture of $C_{44}$-dimeric acid ("PRIPOL 1004" produced by Unichema International), 7 mols of azelaic acid ($C_7$-dimeric acid), 7 mols of ethylenediamine and 13 mols of xylylenediamine. The polyamide resin (1) has an average molecular weight of about 50,000. As examples of the lubricant of the invention, N,N'-ethylene bis lauric acid amide ("Slipacks L" produced by Nippon Kasei Chemical Co., Ltd., melting point=151° C., boiling point=about 400° C., molecular weight=424) and N,N'-ethylene bis stearic acid amide ("Slipacks E" produced by Nippon Kasei Chemical Co., Ltd., melting point=142° C., boiling point=about 380° C., molecular weight=592) were used. As the compatibilizer of the invention, N,N'-xylylene bis stearic acid amid ("Slipacks PXS" produced by Nippon Kasei Chemical Co., Ltd., melting point=123° C., boiling point=about 390° C., molecular weight=668) was used. As examples of the highly volatile amide and/or amine compound(s), 3-acetylindole (melting point=188° C., boiling point=about 280° C., molecular weight=159), 1-acetylsemicarbazide (melting point=165° C., boiling point=about 300° C., molecular weight=117), N-(1-naphthyl)acetamide (melting point=160° C., boiling point=300° to 350° C., molecular weight=185) N,N'-diacetylpiperazine (melting point=141° C., boiling point=about 290° C., molecular weight=170), N-(2-naphthyl) acetamide (melting point=135° C., boiling point=300° to 350° C., molecular weight=185), butyramide (melting point=117° C., boiling point=216° C., molecular weight=87), N,N'-diethylurea (melting point=113° C., boiling point=263° C., molecular weight=116), stearic acid amide (melting point=109° C., boiling point=about 250° C., molecular weight=283), toluylene diamine (melting point=89° C., boiling point=265° C., molecular weight=122), acetamide (melting point=82° C., boiling point=221° C., molecular weight=59), diacetamide (melting point=79° C., boiling point=216° C., molecular weight=101), and ethyl carbamate (melting point=48° C., boiling point=184° C., molecular weight=89) were used. The above components were melted and mixed at the weight ratios shown in Tables 1 and 2, cooled and pulverized to prepare Binders A to Q. Binder A is a known amide-type binder prepared for the purpose of comparison. Binders R, S and T shown in Table 3 are also known binders prepared for comparison.

TABLE 1

| | POLYAMIDE RESIN (4) | POLYAMIDE RESIN (1) | NYLON 1 2/ ETHER (E40S3) | XYLYLENE BIS STEARIC ACID AMIDE (PXS) | ETHYLENE BIS LAURIC ACID AMIDE (Btb-L) | ETHYLENE BIS STEARIC ACID AMIDE (Btb-s) | N,N'-DIACETYL PIPERAZINE (DAP) |
|---|---|---|---|---|---|---|---|
| A | 45 | | | | 25 | | 30 |
| B | 35 | | | 10 | | | 55 |
| C | | | 35 | | | 5 | 60 |
| D | | 35 | | | 10 | | 55 |
| E | | | 65 | | | 5 | 30 |
| F | | | 70 | | | 10 | 15 |

TABLE 2

| | POLY-AMIDE RESIN (1) | N,N'-BIS STEARIC ACID AMIDE | 3-ACETYLINDOLE | 1-ACETYLSEMI-CARBAZIDE | N-(1-NAPHTHYL) ACETAMIDE | N-(2-NAPHTHYL) ACETAMIDE | BUTYRAMIDE | N,N'-DIETHYLUREA |
|---|---|---|---|---|---|---|---|---|
| G | 40 | 10 | 50 | | | | | |
| H | 40 | 10 | | 50 | | | | |
| I | 40 | 10 | | | 50 | | | |
| J | 40 | 10 | | | | 50 | | |
| K | 40 | 10 | | | | | 50 | |
| L | 40 | 10 | | | | | | 50 |
| | | | STEARIC ACID AMIDE | TOLUYLENEDI-AMINE | ACETAMIDE | DIACETAMIDE | ETHYL CARBAMATE | |
| M | 40 | 10 | 50 | | | | | |
| N | 40 | 10 | | 50 | | | | |
| O | 40 | 10 | | | 50 | | | |
| P | 40 | 10 | | | | 50 | | |
| Q | 40 | 10 | | | | | 50 | |

TABLE 3

| | POLYPROPYLENE | PARAFFIN WAX (45°) | EVA | DENATURED ACRYLIC SUBSTANCE | DBP | SUBLIMATE SUBSTANCE NAPHTHALENE |
|---|---|---|---|---|---|---|
| R | 45 | 55 | | | | |
| S | 60 | 40 | | | | |
| T | | 37 | 23 | 15 | 10 | 15 |

Figure 2:
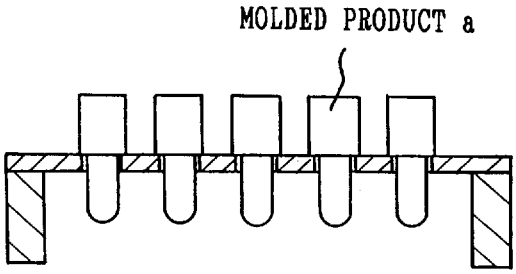
FIG. 2 shows the molded products a as being arranged for the degreasing process.
Figure 3:
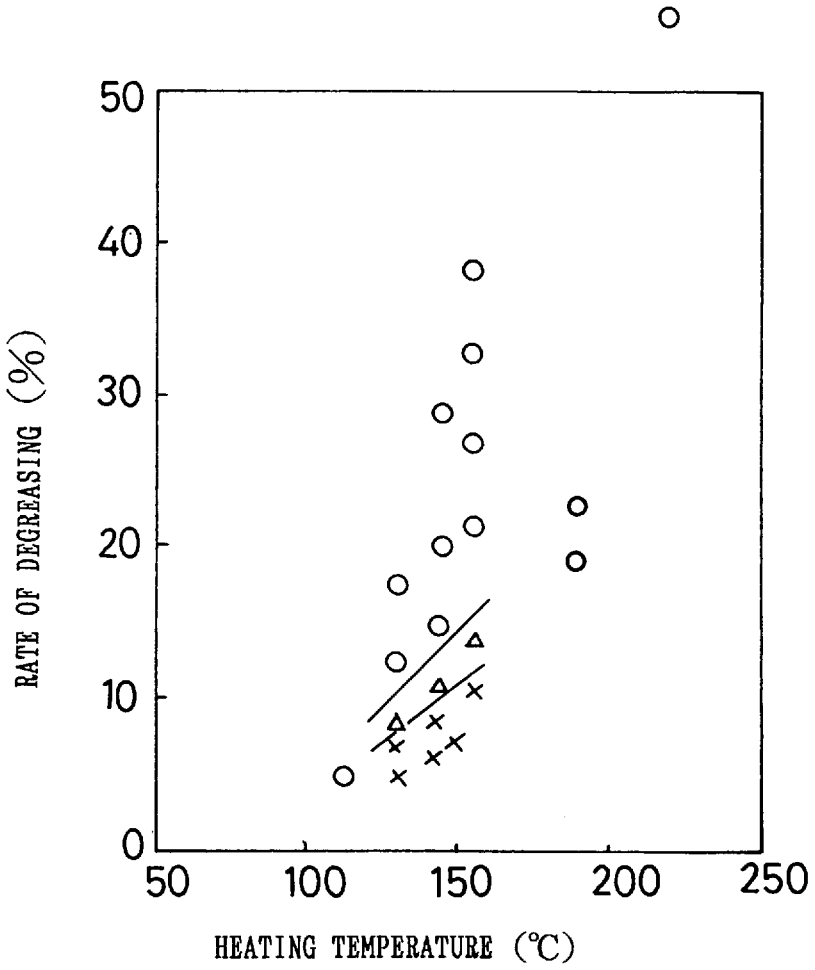
FIG. 3 is a graph showing the relationship between the rate of degreasing, heating temperature and deformation occurring in degreasing when the molded products a are processed.

(B) Preparation of sintered products by thermal decomposition 10.5 parts of Binder A was added to 100 parts of a stainless steel fine powder (SUS430, average particle diameter=10 microns) produced by the water-atomizing method and the mixture was kneaded while heating at 150° C. Then, the mixture was cooled and pulverized to prepare an injection molding material. Under the injection molding conditions (injection temperature=140° C., pressure= approximately 700 kgs/cm$^2$), molded products a as shown in FIG. 1 were prepared from the molding material. The molded products a each had a weight of about 45 grams and thickness of about 3 mm. The molded products a when arranged for degreasing operation are shown in FIG. 2. In this position, the weight of the small diameter part is imposed on the transition section between the small diameter part and the large diameter part. Therefore, the evaluation of deformation occurring in degreasing is carried out based on this part. As the melting point of Binder A in thermal decomposition is 125° to 130° C., the length of each molded product a and the rate of degreasing were checked, with the temperature rising rate being changed in the region from 110° C. to 200° C. FIG. 3 shows the result. In FIG. 3, the circle marks represent molded products whose sizes were changed within ±0.05 mm and therefore judged to be free from deformation. The triangle marks represent molded products which were elongated within 0.2 mm while the cross marks represent molded products which were deformed to a degree of 0.2 mm or more and slightly cracked. It can be understood from this result that when the heating temperature is 130° C., the boundary between the rate of degreasing causing no deformation and the rate of degreasing causing deformation is about 10% by weight. It has been also found that molded products were not deformed under the conditions that heating temperature was 165° C. that was the melting point of the polyamide resin and the rate of degreasing was about 15 wt % or more. When the rate of degreasing was 20 wt % or more, no deformation occurred with heating temperatures lower than or equal to 200° C.

Figure 4:
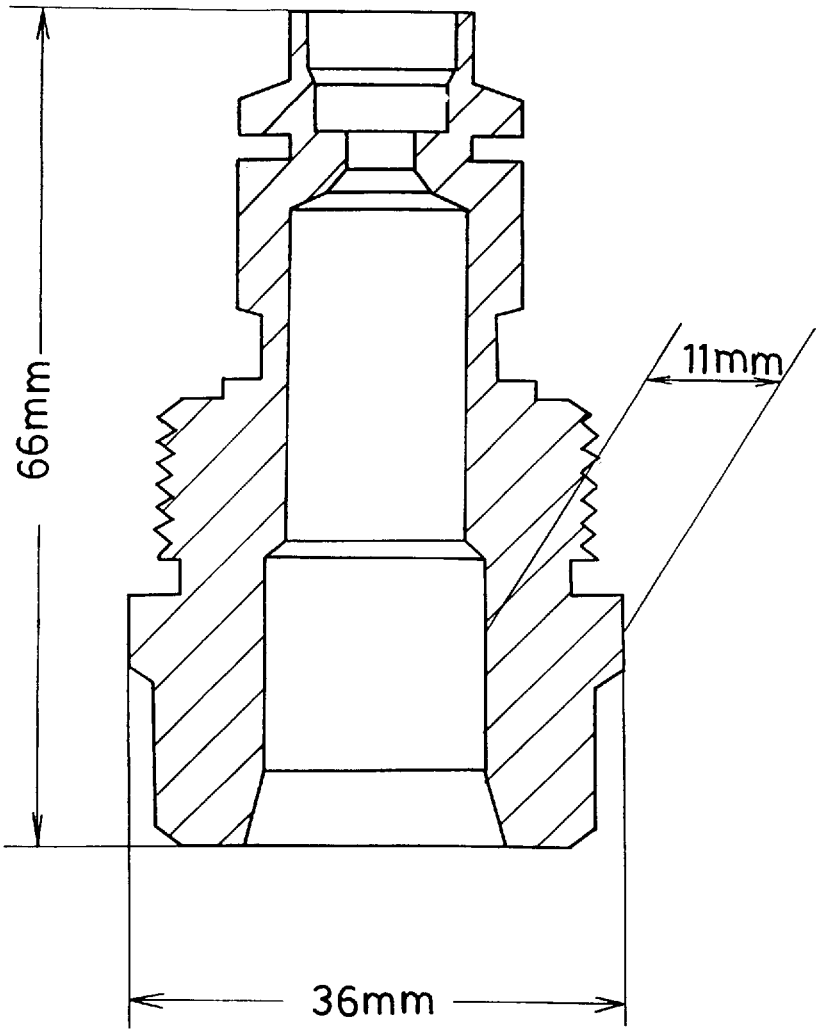
FIG. 4 is a sectional view of a molded product b.

10.5 parts of Binders A to Q and R to T were respectively added to 100 parts of the same stainless steel fine powder as was used in the first example and the mixtures were respectively kneaded while heating at 120° to 150° C. Then, the mixtures were cooled and pulverized to prepare injection molding materials. Under the injection molding conditions (injection temperature=120° to 175° C., pressure= approximately 700 kgs/cm$^2$), molded products b as shown in FIG. 4 were prepared from the molding materials. The molded products b each had a weight of about 130 grams and maximum thickness of 11 mm, and were very large in size as parts to which the injection molding technique is applicable.

The maximum temperature of the first step of the degreasing process was set to 90° to 200° C. to conform to the highly volatile compound of each binder. After the molded products b had been heated at pressures of about 0.2 torr and 2.0 torr for 24 hours while the heating temperature being gradually increased, they were placed in a heat circulating furnace in which $N_2$ gas flew at a wind speed of 1.0 m/s and heated for 8 hours until the final temperature of 350° C. was reached, thereby performing the degreasing of Level 2 to remove the residual binder components. The total degreasing time was 32 hours for all the samples. Also, the same temperature rising pattern was adopted, in which the molded products were held for a specified period of time at a temperature 10° C. lower than the melting point of each highly volatile compound and at 155° C. that was lower than the melting point of the polyamide resin. After the observation of deformation and cracking which had occurred during the degreasing process, acceptable degreased products underwent vacuum sintering at 1,240° C. for 4 hours.

Table 4 shows the evaluation of the molded products, degreased products and sintered products thus obtained. In Table 4, the cross marks represent products in which significant degreasing deformation and/or cracking occurred; the triangle marks represent products in which virtually no deformation was admitted but small cracks occurred; and the circle marks represent products free from degreasing defects. The line marks represent the cases where sintering was not carried out because no acceptable degreased product was obtained. In the cases of Binders R, S and T, the injection molded products obtained were not acceptable but they underwent the degreasing process to check the degreasing property of Binders R, S and T and were found to be deformed by degreasing.

TABLE 4

| | PARTS BY WEIGHT OF BINDER PARTS 100 PARTS BY WEIGHT OF POWDER MATERIAL | INJECTION MOLDING TEMPERATURE | CONDITION OF MOLDED PRODUCT (10 SAMPLES) FAIR | CHIPPED, CRACKED | MAXIMUM TEMPERATURE OF FIRST DEGREASING STEP (°C.) | VACUUM LEVEL OF FIRST DEGREASING STEP & CONDITION OF DEGREASED PRODUCT PRESSURES OF 0.1 TO 0.2 torr | PRESSURES OF 1 TO 2 torr | VACUUM LEVEL OF FIRST DEGREASING STEP & CONDITION OF SINTERED PRODUCT PRESSURES OF 0.1 TO 0.2 torr | PRESSURES OF 1 TO 2 torr | VACUUM LEVEL OF FIRST DEGREASING STEP & SINTERING DENSITY PRESSURES OF 0.1 TO 0.2 torr | PRESSURES OF 1 TO 2 torr |
|---|---|---|---|---|---|---|---|---|---|---|---|
| A | 10.5 | 140 | 10 | 0 | 170 | xx | xx | — | — | | |
| B | ↑ | 140 | 10 | 0 | 170 | ○○ | ○○ | ○○ | ○○ | 7.73 | 7.72 |
| C | ↑ | 140 | 10 | 0 | 170 | ○○ | ○Δ | ○○ | ○Δ | 7.72 | 7.72 |
| D | ↑ | 140 | 10 | 0 | 170 | ○○ | ΔΔ | ○○ | ΔΔ | 7.72 | 7.71 |
| E | ↑ | 140 | 10 | 0 | 170 | xx | — | — | — | | |
| F | ↑ | 160 | 10 | 0 | 170 | xx | — | — | — | | |
| G | ↑ | 175 | 10 | 0 | 210 | ○○ | ○○ | ○○ | ○○ | 7.71 | 7.73 |
| H | ↑ | 150 | 10 | 0 | 190 | ○○ | ○○ | ○○ | ○○ | 7.72 | 7.73 |
| I | ↑ | 150 | 10 | 0 | 190 | ○○ | ΔΔ | ○○ | ΔΔ | 7.71 | 7.72 |
| J | ↑ | 140 | 10 | 0 | 170 | ○○ | xx | ○○ | — | 7.73 | — |
| K | ↑ | 140 | 10 | 0 | 150 | ○○ | ○○ | ○○ | ○○ | 7.72 | 7.73 |
| L | ↑ | 130 | 10 | 0 | 150 | ○○ | ΔΔ | ○○ | ΔΔ | 7.71 | 7.72 |
| M | ↑ | 130 | 10 | 0 | 150 | ○○ | ○○ | ○○ | ○○ | 7.70 | 7.72 |
| N | ↑ | 130 | 10 | 0 | 130 | ○○ | xx | ○○ | — | — | — |
| O | ↑ | 120 | 10 | 0 | 130 | ○○ | xx | ○○ | — | — | — |
| P | ↑ | 120 | 10 | 0 | 130 | ○○ | ○○ | ○○ | ○○ | 7.70 | 7.70 |
| Q | ↑ | 120 | 9 | 1* | 90 | ○○ | xx | ○○ | — | 7.69 | — |
| R | ↑ | 145 | 0 | 10 | 110 | xx | — | — | — | — | — |
| S | ↑ | 145 | 5 | 5 | 110 | xx | — | — | — | — | — |
| T | ↑ | 150 | 3 | 7 | | xx | — | — | — | — | — |

MARK —: NO TEST EFFECTED, MARK ○: FAIR, MARK Δ: SMALL CRACK, MARK x: DEFORMATION, LARGE CRACK
*CRACK IN THREAD SECTION

Figure 5:
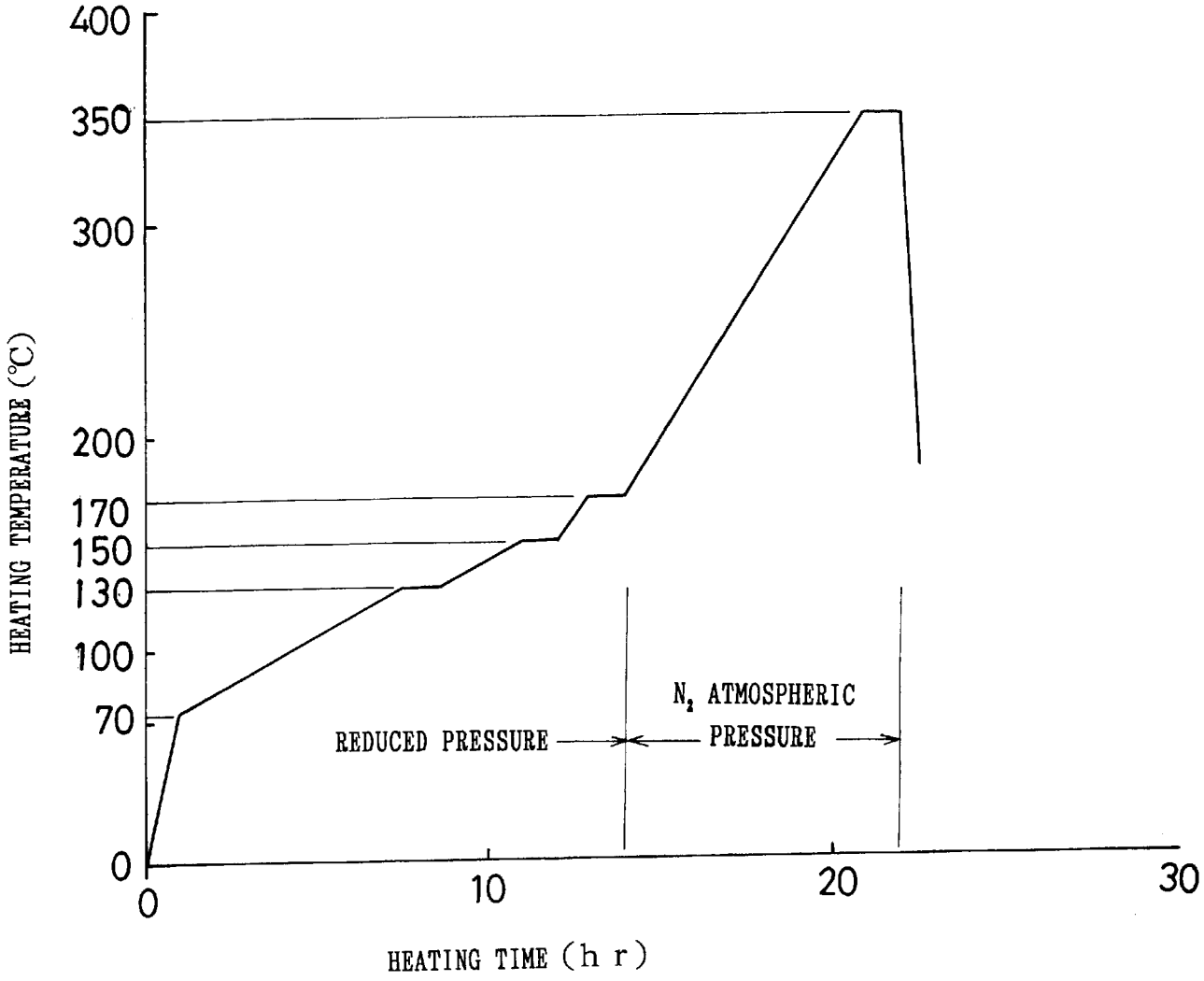
FIG. 5 is a graph of a temperature rising pattern in 22-hour degreasing.

Next, the effect of each binder on a reduction in degreasing time was checked. The molded products formed by use of Binders A to F underwent the first step of the degreasing process with different degreasing time periods (7 to 100 hours) and then underwent the second step in an atmosphere of $N_2$ gas with different degreasing time periods of 8 hours and 33 hours. The vacuum level of the first step of the degreasing process was about 0.2 torr. The temperature rising patterns for these examples were obtained by proportionally reducing or enlarging the pattern in the case of 22 hours shown in FIG. 5 according to the degreasing time periods of 7 to 100 hours. The maximum temperature was 170° C. and the final temperature of the degreasing process was 350° C. Heating temperature rose over a period of 8 hours, starting after completion of the first step.

Table 5 shows the incidence of defects in each degreased product obtained after degreasing. The meaning of the cross, triangle and circle marks is the same as that explained above.

TABLE 5

170° C., 0.1 TO 0.2 torr

| $t_0$ | $t_1$ 8 hr | | $t_1$ 33 hr | $t_0$ | $t_1$ 8 hr | | $t_1$ 33 hr | |
|---|---|---|---|---|---|---|---|---|
| 7 | A | xx | A | 44 | A | xx | A | xΔ |
| hr | B | ΔΔ | B | hr | B | ○○ | B | |
| | C | Δx | C | | C | ○○ | C | |
| | D | xx | D | | D | ○○ | D | |
| | E | xx | E | | E | xx | E | |
| | F | xx | F | | F | xx | F | |
| 14 | A | xx | | 59 | A | ○○ | A | |
| hr | B | ○○ | | hr | B | ○○ | B | |
| | C | ○○ | | | C | ○○ | C | |
| | D | xx | | | D | ○○ | D | |
| | E | xx | | | E | ○○ | E | |
| | F | xx | | | F | xx | F | |
| 24 | A | xx | | 80 | A | ○○ | A | |
| hr | B | ○○ | | hr | B | ○○ | B | |
| | C | ○○ | | | C | ○○ | C | |
| | D | ○○ | | | D | ○○ | D | |
| | E | xx | | | E | ○○ | E | |
| | F | xx | | | F | xx | F | xΔ |
| 34 | A | xx | xx | 100 | A | ○○ | A | |
| hr | B | ○○ | | hr | B | ○○ | B | |
| | C | ○○ | | | C | ○○ | C | |
| | D | ○○ | | | D | ○○ | D | |
| | E | xx | xx | | E | ○○ | E | |
| | F | xx | xx | | F | ΔΔ | F | ΔΔ |

Figure 6:
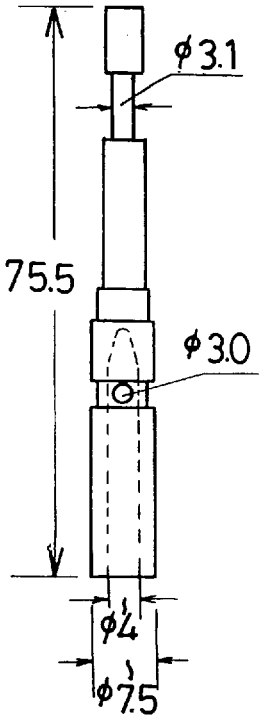
FIG. 6 is a sectional view of a molded product c.

Binders A, D, S and T were respectively added to a carbonyl iron dust material ("CS iron fine powder" produced by BASF Corporation, mean particle diameter: 5 microns). The mixtures were respectively kneaded while being heated at a temperature of 140° C., cooled and pulverized. Then, the mixtures were injection-molded at a pressure of 660 kg/$cm_2$ into molded products c as shown in FIG. 6. Then, these molded products c were degreased under the conditions that (1) Level 1: the molded products c were placed in a heat recirculating furnace in which $N_2$ gas (10 N1/min) mixed with 0 to 0.5% by volume of $CO_2$ flew at 1.0 m/sec. and degreased over a period of 50 hours until the final temperature (350° C.) was reached; (2) Level 2: degreasing was performed by effecting the first step of the degreasing process shown in Table 4 for 24 hours and then effecting the second step for 8 hours in the same atmosphere of the mixture gas of $N_2$ and $CO_2$ as described in Level 1. Subsequent to the degreasing process, vacuum sintering was carried out at 1,200° C. for 1 hour. The reason why it took such a long time to carry out degreasing is to prevent deformation of the molded product of Binder A. Further, In order to prevent occurrence of internal cracking in the molded product of Binder A, removal of stress was carried out by heating at 110° C. in an atmosphere of $N_2$ gas for 4 hours.

Binders S and T containing large amounts of paraffin wax and/or butyl phthalate were poor in strength so that the molded products c formed from Binders S and T were all partially broken. These products could not undergo the subsequent degreasing for adjustment of the residual carbon content and sintering. Therefore, a residual carbon content adjustment test was conducted on the molded products prepared from Binders A and D which had good strength.

No defects were found in the molded products of Binders A and D after degreasing in an atmosphere of the $CO_2$ mixture gas. The result of an analysis of carbon after sintering is shown in Table 6.

TABLE 6

| | PARTS BY WEIGHT OF BINDER PER 100 PARTS BY WEIGHT OF POWDER MATERIAL | INJECTION MOLDING TEMPERATURE (°C.) | CONDITION OF MOLDED PRODUCT (50 SAMPLES) FAIR | CHIPPED, CRACKED | LEVEL OF DEGREASING CONDITION | VOLUME OF $CO_2$ GAS INTRODUCED INTO $N_2$ (%) | 0% $CO_2$ | 0.12% $CO_2$ | 0.24 | 0.36 | 0.50 |
|---|---|---|---|---|---|---|---|---|---|---|---|
| A | 9.0 | 140 | 50 | 0 | LEVEL 1 | INCIDENT OF DEFECTS IN DEGREASING PRODUCT | 0/50 | 0/50 | 0/50 | 0/50 | 0/50 |
| | | | | | | DENSITY OF SINTERED PRODUCT | 7.72 | 7.70 | 7.69 | 7.71 | 7.68 |
| | | | | | | CARBON CONTENT OF SINTERED PRODUCT | 0.80 | 0.61 | 0.48 | 0.32 | 0.21 |
| | | | | | LEVEL 2 | INCIDENT OF DEFECTS IN DEGREASING PRODUCT | 0/50 | 0/50 | 0/50 | 0/50 | 0/50 |
| | | | | | | DENSITY OF SINTERED PRODUCT | 7.71 | 7.71 | 7.68 | 7.69 | 7.67 |
| | | | | | | CARBON CONTENT OF SINTERED PRODUCT | 0.82 | 0.63 | 0.48 | 0.35 | 0.22 |
| D | 9.0 | 140 | 50 | 0 | LEVEL 1 | INCIDENT OF DEFECTS IN DEGREASING PRODUCT | 0/50 | 0/50 | 0/50 | 0/50 | 0/50 |
| | | | | | | DENSITY OF SINTERED PRODUCT | 7.71 | 7.68 | 7.68 | 7.70 | 7.69 |
| | | | | | | CARBON CONTENT OF SINTERED PRODUCT | 0.64 | 0.43 | 0.30 | 0.19 | 0.13 |
| | | | | | LEVEL 2 | INCIDENT OF DEFECTS IN DEGREASING PRODUCT | 0/50 | 0/50 | 0/50 | 0/50 | 0/50 |
| | | | | | | DENSITY OF SINTERED PRODUCT | 7.69 | 7.69 | 7.71 | 7.70 | 7.71 |
| | | | | | | CARBON CONTENT OF SINTERED PRODUCT | 0.63 | 0.45 | 0.32 | 0.19 | 0.12 |
| S | 9.0 | 145 | 0 | 50 | | NO TEST WAS EFFECTED BECAUSE NO ACCEPTABLE INJECTION MOLDED PRODUCTS WERE OBTAINED | | | | | |
| T | 9.0 | 145 | 0 | 50 | | | | | | | |

(C) Test result (1) Deformation caused by degreasing (see FIG. 3)

The relationship between the amount of degreasing deformation, degreasing temperature and the rate of degreasing was analyzed using Binder A. It has been found from the result of the analysis that, provided that the rates at which the highly volatile compound is degreased at 130° C. (=the melting point of Binder A based on the thermal analysis) and at 155° C. (=the melting point of the polyamide resin based on the thermal analysis) are 10 wt % or more and 15 wt % or more respectively, degreasing deformation can be prevented even if the molded products are arranged in such a severe condition as shown in FIG. 2. Also, it has been found that, in order to effectively utilize the principle of vaporization under reduced pressure in the first step of the thermal decomposition degreasing method of the invention, the amount of the highly volatile organic compound is 15 wt % or more and, more preferably, 20 wt % or more. It has been found that, if a degreasing rate of 15 wt % or more can be achieved when heating temperature is equal to the melting point of the polyamide resin, temperature can be raised to more than the melting point of the polyamide resin, which has good effects on prevention of degreasing deformation and on degreasing time reduction.

(2) The result of a 32-hour degreasing test (see Table 4)

When degreasing the injection molded products of Binders A to Q, the molded product of Binder Q had defects due to a drop in the strength of the binder because the major constituent of Binder Q was ethyl carbamate. No defects were found in the molded products formed from other polyamide type binders. Since considerable lack of strength could be anticipated for the known Binders R, S and T which were prepared for comparison, mold temperature was set to as low as 20° C. and cooling time for the products within the molds was set to 2 minutes or more. However, the molded products obtained were virtually defective. In order to check the degreasing property of these binders, a degreasing test was conducted on these defective products.

The degreasing property of each binder was evaluated from the integrity and cracks of the molded products obtained after degreasing. In the test conducted under a pressure of 0.2 torr, considerable degreasing deformation, foams and large cracks were found in the molded products prepared from Binders A, E and F which respectively contained no more than 30 wt % the highly volatile amide and/or amine compound(s). Considerable deformation was also found in the molded products formed from Binders R, S and T prepared for comparison. The molded products prepared from the binders containing the highly volatile organic compound by 50 wt % achieved a good result. When the first step was effected under a pressure of 2 torr, the binders having high vapor pressures at their melting points achieved acceptable degreased products while those having low vapor pressures suffered from deformation and cracking. A marked good effect could be obtained under vacuum conditions attained by a rotary pump.

The binder which had been removed from the molded product in the first step of the degreasing process was cooled and collected in a simple way with a pipe line outside a furnace, the pipe line being provided with a bellows which was made from 2 mm-thick stainless steel, having an inner diameter of about 12 cm and length of about 30 cm and installed in front of a Roots pump. Except for the case of Binder Q, all the binders accomplished 100% collection with no troubles in the vacuum pumping system. However, in the case of Binder Q, the vacuum oil in the Roots pump and rotary pump became cloudy during degreasing. From this case, it has been found that a collector of higher cooling performance is necessary. In the cases of the molded products prepared from Binders A to F, when the maximum temperature in the first step was increased to 250° C., large amounts of whitish coagulation deposited within the Roots pump causing a clog to the Roots pump. It is also understood from this result that use of a higher cooling performance collector is necessary. It was found from a research of vapor pressure and thermal decomposition that the deposits collected from the pumps were N,N'-diacetyl piperazine and the thermal decomposition substances generated from the lubricant and compatibilizer. Hence, in order to avoid the above troubles, it is preferable that the maximum temperature in the first step of the degreasing process be no more than 230° C. and preferably be limited to no more than 200° C. Also, it is preferable to select amide and/or amine compound(s) having a melting point of 70° C. or more as the highly volatile organic compound. Note that acceptable degreased products produced acceptable products having sufficient sintering density in the sintering process.

(3) Degreasing time and degreasing time reduction effect (see Table 5)

The degreasing time reduction effect of Binders A to F was checked from degreasing of 11 mm-thick molded products as shown in FIG. 6 which had been prepared from a mixture of a stainless steel fine powder (SUS430) and Binders A to F. In this degreasing test, the vacuum level and maximum temperature of the first step of the degreasing process were 0.1 to 0.2 torr and 170° C., respectively. From the molded products prepared by use of Binders B and C, acceptable degreased products were obtained after a total degreasing time of 22 hours. In the case of Binder D, an acceptable degreased product could be obtained after degreasing for 32 hours. As to Binders A and E respectively containing 30 wt % N,N'-diacetyl piperazine, acceptable degreased products could not be obtained until degreasing had been performed for 67 hours. In the case of Binder F containing 15 wt % N,N'-diacetyl piperazine, a sound degreased product could not be obtained even after degreasing for 133 hours. It can be understood from the result that when a binder mainly contains N,N'-diacetyl piperazine as the highly volatile organic compound, the degreasing time reduction effect can be achieved at a higher rate than the rate proportional to the amount of N,N'-diacetyl piperazine and hence, the preferable amount of the highly volatile organic compound for practically reducing degreasing time is 40 wt % or more.

(4) Residual carbon content adjustment by use of $CO_2$ gas (see Table 6)

The amount of residual carbon in a sintered product was checked in the following cases: (i) Level 1: whole the process of degreasing was carried out at atmospheric pressure in an atmosphere of $N_2$ gas to which different amounts of $CO_2$ gas were introduced; (ii) Level 2: after heating had been carried out in vacuum in the first degreasing step, heating was carried out at atmospheric pressure in an atmosphere of $N_2$ gas to which different amounts of $CO_2$ gas were introduced. It was found from the test that significant ability for controlling the carbon content could be achieved when 0.5% by volume of $CO_2$ gas was introduced in both cases (i) and (ii). In addition, the degreased products obtained after completion of degreasing were all acceptable, being free from degreasing defects such as cracks.

From the fact that when $CO_2$ is used in place of $N_2$ gas, the temperature upon completion of degreasing is usually about 500° C., it is understand that the reaction between carbon and $CO_2$ at this temperature is an endothermic reaction so that $CO_2$ gas serves to create a protective atmosphere. Hence, the upper limit of the amount of $CO_2$ gas to be introduced is 100% by volume. This means that the problems imposed by degreasing in air and degreasing in an atmosphere of enriched oxygen can be solved by degreasing in an atmosphere of $CO_2$ gas.

Although the simplest way of $CO_2$ introduction is to add $CO_2$ alone, there are alternative ways. One is to add a substance such as alcohol which generates $CO_2$ gas through thermal decomposition. Another alternative is to add a mixture gas (e.g. RX gas) containing $CO_2$ and CO or $H_2$.

We claim:

1. A thermal decomposition degreasing method for removing a thermoplastic binder from a product formed by injection molding of a powder material mixed with the thermoplastic binder, the thermoplastic binder comprising a volatile organic compound and a thermoplastic resin, said organic compound being more volatile than said thermoplastic resin, and wherein a degreasing process comprises:

(a) a first step for heating the product at a temperature lower than the melting point of the thermoplastic binder, the product being placed in a reduced pressure condition lower than or equal to atmospheric pressure, so that at least 5 wt. % of the thermoplastic binder is evaporated, and then heating the product to a temperature which is lower than the higher of the (1) a melting point of the organic compound and (2) a melting point of the thermoplastic resin so that at least 10 wt % of the thermoplastic binder is evaporated, the final temperature of the first step being 200° C. or less; and (b) a second step for heating the product up to a temperature that is at least equal to (1) the highest of the melting points of components constituting the thermoplastic binder and/or (2) 200° C., and at a pressure at least equal to atmospheric pressure in an atmosphere of a gas that is inert relative to the powder material of the product.

2. A thermal decomposition degreasing method according to claim 1, $CO_2$ gas is introduced into the inert gas in the second step so that the residual carbon content of a degreased product can be adjusted.

3. A thermal decomposition degreasing method according to claim 1, further comprising a third step of reducing the pressure of the ambient gas so as to be lower than or equal to atmospheric pressure and raising ambient temperature so that at least most of the thermoplastic binder is removed by evaporation and thermal decomposition.

4. A thermal decomposition degreasing method according to claim 3, wherein $CO_2$ gas is introduced into the inert gas in the second and third steps so that the residual carbon content of a degreased product can be adjusted.

5. A thermal decomposition degreasing method according to claim 1, wherein the more volatile organic compound is composed of at least one compound selected from amide and amine compounds.

6. A thermal decomposition degreasing method according to claim 5, wherein said amide compounds each have amide groups while said amine compounds each have amine groups and wherein the amide and amine compounds have melting points ranging from 50° C. to 190° C., boiling points of 175° C. or more and vapor pressures ranging from 0.1 to 100 torr at their melting points.

7. A thermal decomposition degreasing method according to claim 1, wherein said thermoplastic resin is composed of at least one polyamide resin.

8. A thermal decomposition degreasing method according to claim 7, wherein said polyamide resin is composed of a polyamide resin material having 8 or more carbon atoms between amide groups on average and an aromatic bisamide having 8 or more carbon atoms between amide groups on average and serving as a compatibilizer, the polyamide resin material and the aromatic bisamide being mixed substantially at an equal weight ratio.

9. A thermal decomposition degreasing method according to claim 7, wherein said polyamide resin is composed of a polyamide resin material having 10 or more carbon atoms between amide groups on average.

10. A thermal decomposition degreasing method according to claim 8 or 9, wherein said polyamide resin material is prepared from copolycondensation of (i) $C_{36}$-dimeric acid, $C_{44}$-dimeric acid, or a mixture of $C_{36}$-dimeric acid and $C_{44}$-dimeric acid, (ii) aliphatic dicarboxylic acid having 6 to 10 carbon atoms, (iii) xylylenediamine, and (iv) ethylenediamine and/or hexamethylenediamine.

11. A thermal decomposition degreasing method according to claim 10, wherein the average molecular weight of the polyamide resin material is 20,000 or more.

12. A thermal decomposition degreasing method according to claim 8 or 9, wherein said polyamide resin material contains nylon 11 and nylon 12.

13. A thermal decomposition degreasing method according to claim 7, 8, or 9, wherein the average molecular weight of the polyamide resin material is 13,000 or more.

14. A thermal decomposition degreasing method according to claim 1, wherein said thermoplastic binder contains 20 to 80 wt % the more volatile amide and/or amine compound (s) and 20 to 65 wt % the thermoplastic resin.

15. A thermal decomposition degreasing method according to claim 14, wherein the thermoplastic binder contains a lubricant which comprises no more than 15 wt % fatty acid amide.

16. A thermal decomposition degreasing method according to claim 1, wherein the more volatile organic compound which has been vaporized in vacuum or at a reduced pressure lower than atmospheric pressure is cooled, solidified and collected outside a furnace.

17. A thermal decomposition degreasing method according to claim 1, wherein the thermoplastic binder which has been vaporized in a low temperature region in the second step is cooled, solidified, liquefied and collected outside a furnace.

18. A thermal decomposition degreasing method according to claim 1, wherein evaporative gas and/or decomposition gas generated during the degreasing process is introduced together with hot air into a second furnace heated to 800° C. or more outside a first furnace so that said gases are decomposed by combustion.

19. A molded product of the degreasing method of any one of claims 1 to 9.

20. A molded product obtained by degreasing or sintering of a product from which the residual binder has been removed by thermal decomposition with either of the methods of claims 16 and 17.

21. A thermal decomposition degreasing method according to 12, wherein the average molecular weight of the polyamide resin material is 3,000 or more.

* * * * *